United States Patent [19]

Brooks et al.

[11] 4,143,441

[45] Mar. 13, 1979

[54] VACUUM CLEANER NOZZLE

[75] Inventors: Joseph F. Brooks, Bloomington; Samuel E. Hohulin, Lexington; Scott N. Lockhart, Normal, all of Ill.

[73] Assignee: National Union Electric Corporation, Greenwich, Conn.

[21] Appl. No.: 757,985

[22] Filed: Jan. 10, 1977

[51] Int. Cl.[2] ..... A47L 9/06

[52] U.S. Cl. ..... 15/369; 15/373; 15/402

[58] Field of Search ..... 15/369, 373, 397, 402

[56] References Cited

U.S. PATENT DOCUMENTS

| | | | |
|---|---|---|---|
| 2,228,091 | 1/1941 | Smith | 15/402 |
| 2,649,610 | 8/1953 | Segesman | 15/402 X |
| 3,795,938 | 3/1974 | Caporaso | 15/402 X |
| 3,894,308 | 7/1975 | Carr | 15/402 X |
| 3,965,525 | 6/1976 | Brissette et al. | 15/402 X |

*Primary Examiner*—Christopher K. Moore

*Attorney, Agent, or Firm*—Merriam, Marshall & Bicknell

[57] ABSTRACT

A sole plate and rake latch assembly in a vacuum cleaner nozzle is provided which is capable of making the nozzle effective for both raking and cleaning shag-type rugs and rugs with short nap. The sole plate is provided with forwardly and rearwardly inclined walls extending upwardly from an air intake opening disposed lengthwise therein. A pivotal rake member is mounted adjacent the upper edge of both the forwardly and rearwardly inclined walls with the inclined walls preferably having recesses formed in their outer surface to receive the lower ends of the rake members in nesting position therein. Several rake latching means are provided which enable the rake members to be moved into either raking position or in nesting position.

8 Claims, 39 Drawing Figures

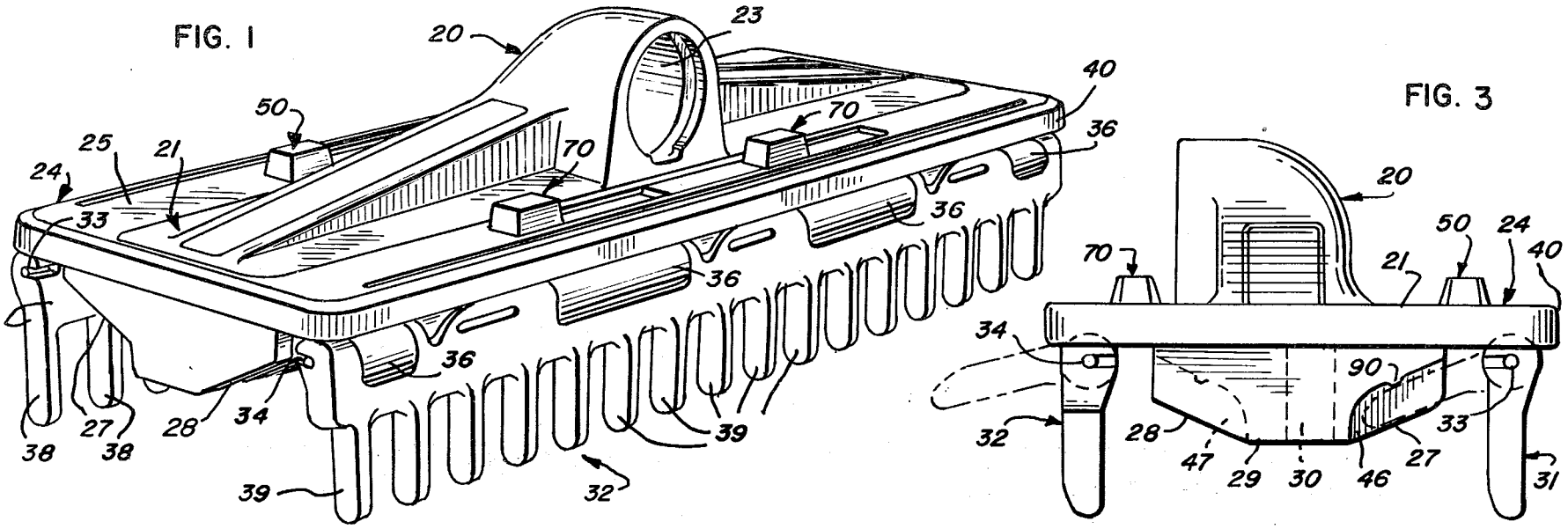
FIG. 1
FIG. 3
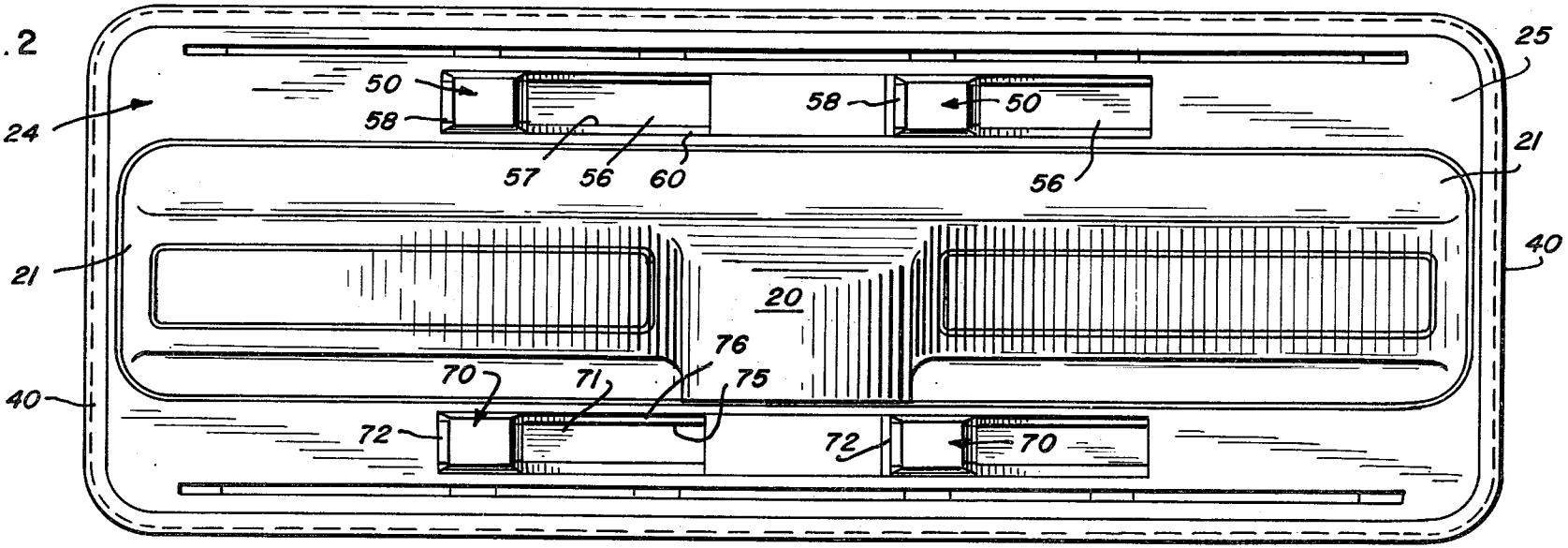
FIG. 2

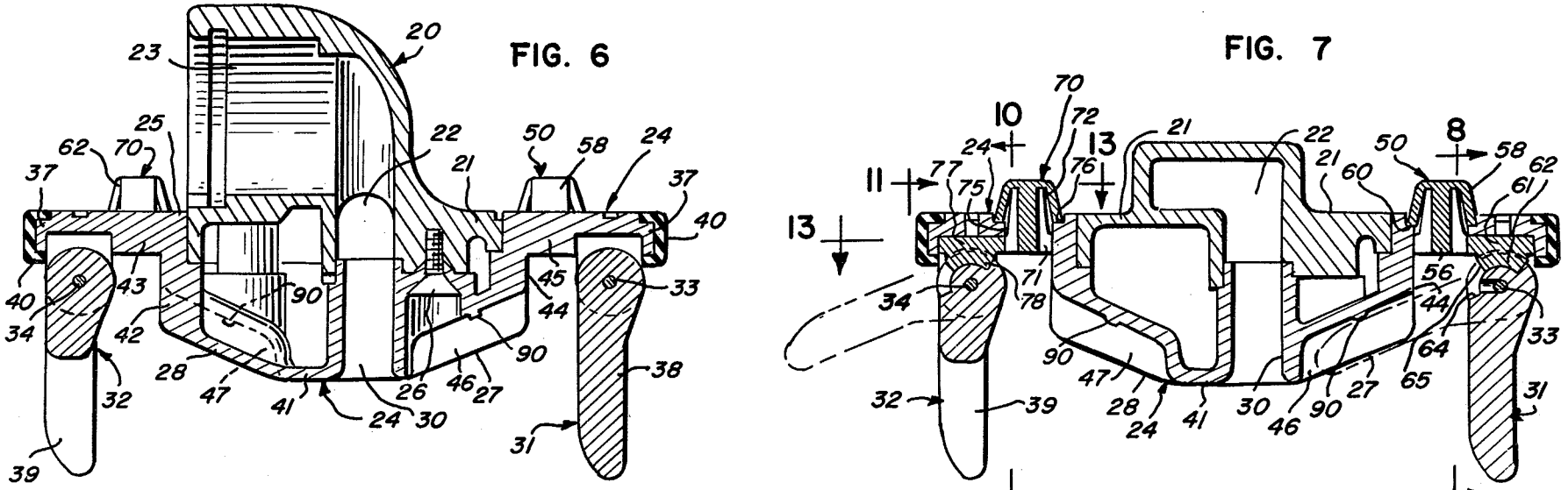
FIG. 6
FIG. 7
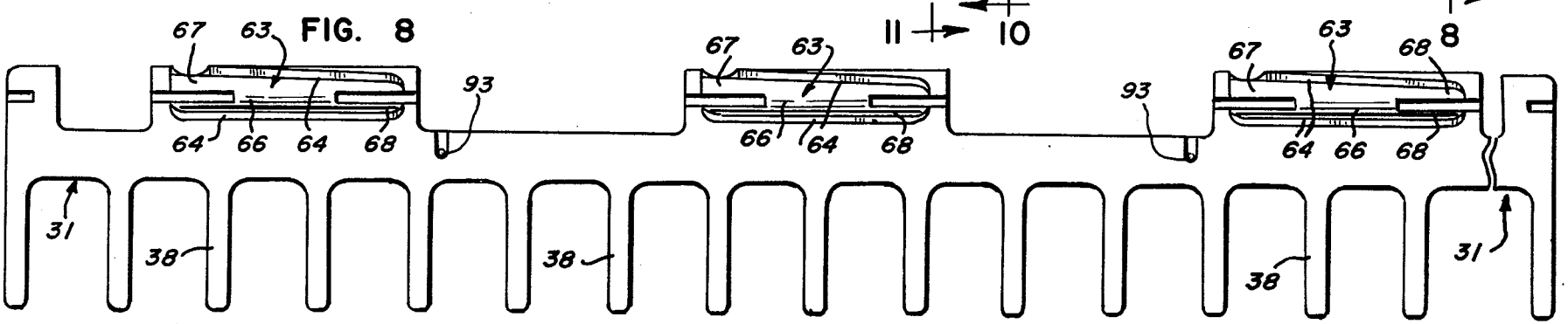
FIG. 8
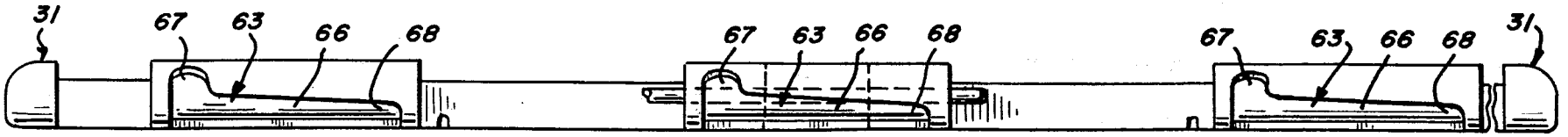
FIG. 9

16
16

VACUUM CLEANER NOZZLE

This invention relates generally to an improvement relating to vacuum cleaners, and more particularly to providing vacuum cleaners, such as canister, lightweight upright and stick type vacuum cleaners, with means which adapt the nozzle for cleaning both a shag-type rug having long pile and a rug having short pile.

Many nozzles for a tank-type vacuum cleaner have been devised for cleaning conventional short-nap rugs and various attachments have been provided for adapting these conventional tank-type vacuum cleaning nozzles for cleaning or raking a shag-type rug. More recently, vacuum cleaner nozzles have been designed specifically for use on shag-type rugs, such as U.S. Pat. Nos. 3,633,241 and 3,733,646. While the known prior art vacuum cleaning nozzles which are adapted for use on shag-type rugs are intended for either raking or cleaning a shag-type rug, none of these prior art shag rug cleaning or raking nozzles are also capable of effectively cleaning a rug with short nap or cleaning bare floors. Thus, it has heretofore been necessary to remove the shag rug-type attachment from the nozzle or substitute a conventional vacuum cleaner nozzle when it is desired to clean a conventional short nap rug or bare floor. Moreover, most shag-type rug nozzles and nozzle attachments are really effective only for raking and do not effectively clean a shag rug or bare floor.

It is therefore an object of the present invention to provide a vacuum cleaner nozzle which can be used effectively for cleaning and raking a shag-type rug and which is also adapted to effectively clean rugs and carpeting having short nap or bare floors.

It is still another object of the present invention to provide a nozzle for a tank-type vacuum cleaner which more effectively utilizes the flow of air for cleaning shag-type rugs and rugs with short nap or pile.

It is also an object of the present invention to provide a nozzle for a vacuum cleaner with improved means for both raking and cleaning a shag-type rug during movement of the nozzle over the shag-type rug surface.

It is a further object of the present invention to provide a vacuum cleaner nozzle which has improved means for controlling and positioning a shag-type rug raking member.

Other objects of the present invention will be apparent from the detailed description and claims to follow when read in conjunction with the accompanying drawings, wherein:

FIG. 1 is a perspective view of a vacuum cleaner nozzle with a sole plate and rake latch assembly embodying the present invention in position for combing a shag rug;

FIG. 2 is a top plan view of the vacuum cleaner nozzle with sole plate and rake latch assembly of FIG. 1;

FIG. 3 is an end elevational view of the nozzle with sole plate and rake latch assembly of FIG. 1;

FIG. 6 is a vertical sectional view taken along the line 6—6 of FIG. 4;

FIG. 7 is a vertical sectional view taken along the line 7—7 of FIG. 4;

Figure 4:
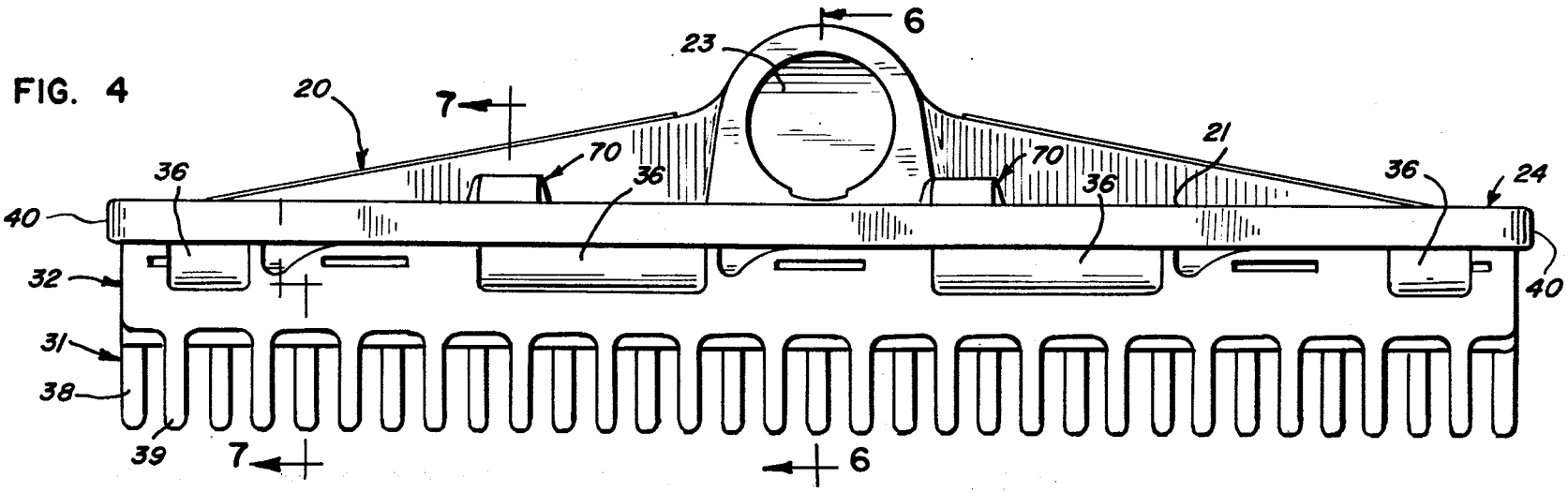
FIG. 4 is a rear elevational view of the nozzle with sole plate and rake latch assembly of FIG. 1.
Figure 5:
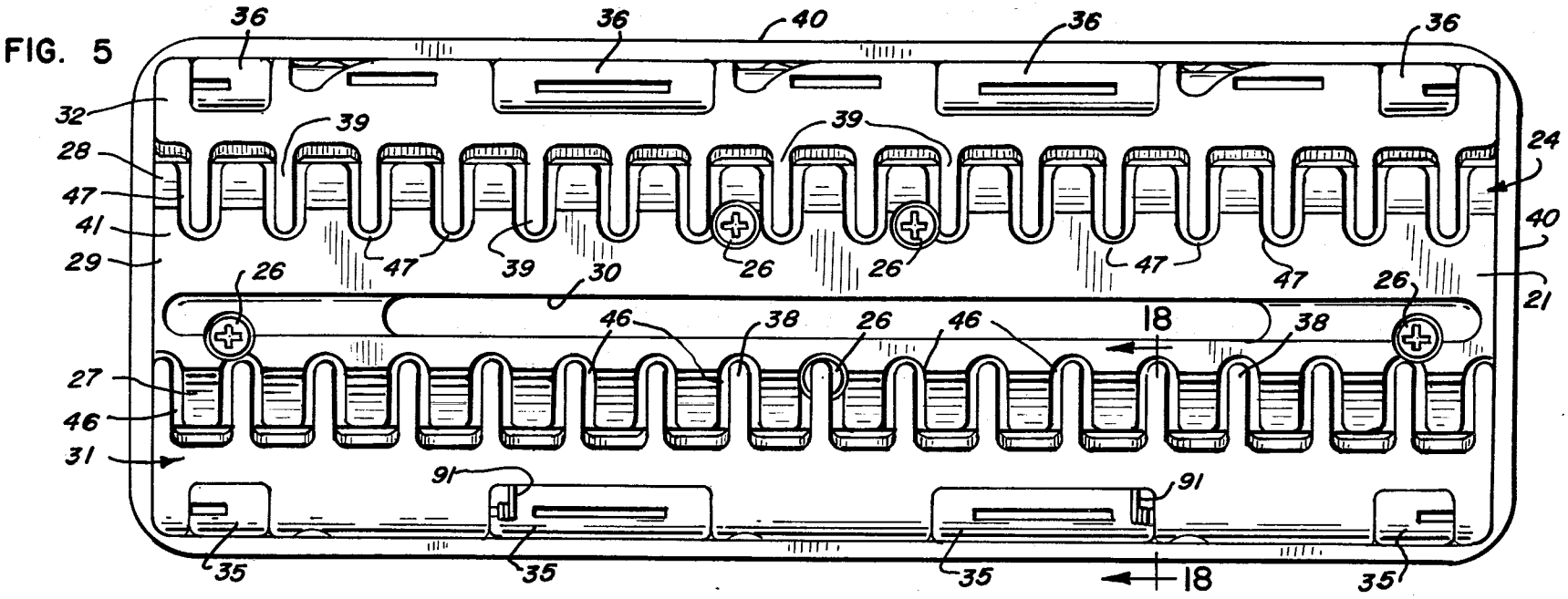
FIG. 5 is a bottom view of the nozzle with sole plate and rake latch assembly of FIG. 1 in an alternate position of adjustment for cleaning a short pile rug or floor.
Figure 8A:
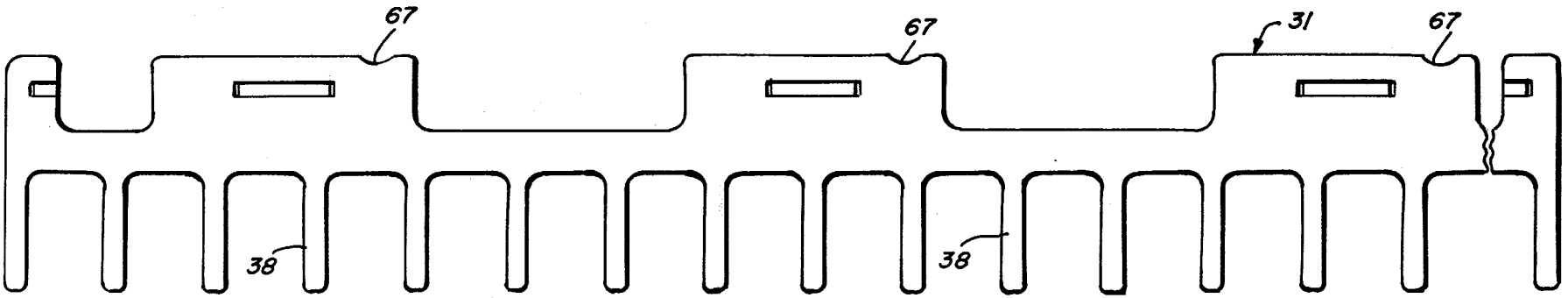
FIG. 8 is a fragmentary rear elevational view of the front rake member taken along the line 8—8 of FIG. 7.
Figure 18:
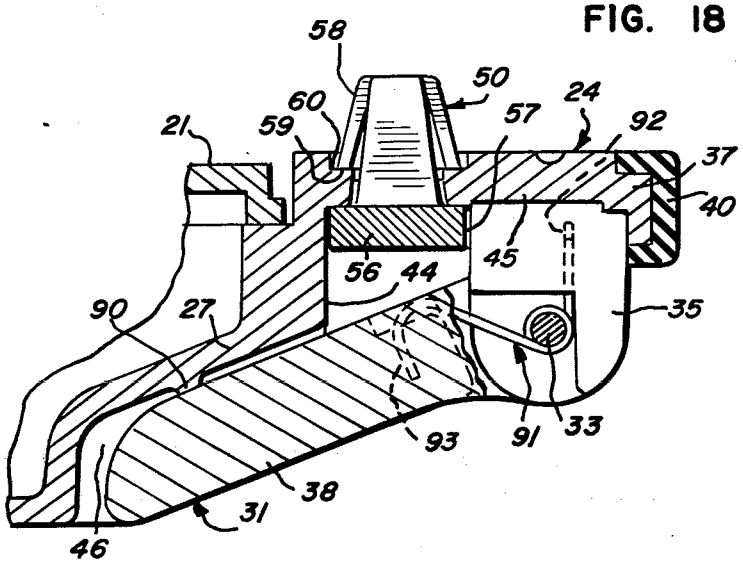
Figure 17:
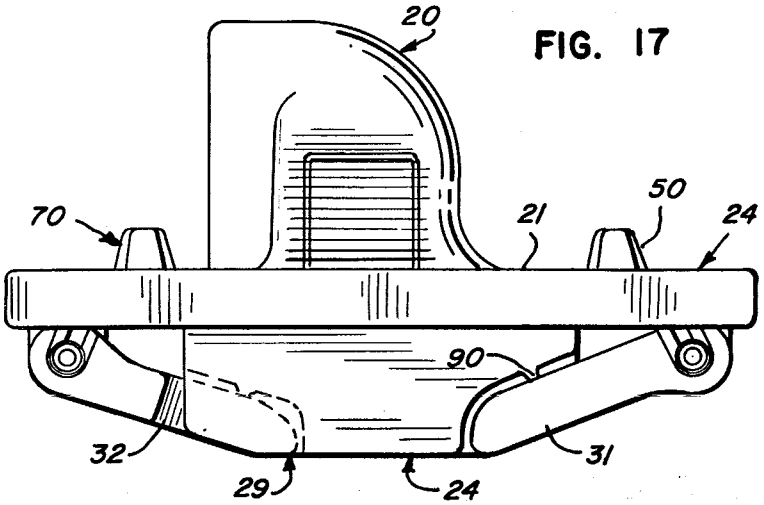
Figures 10, 11, 12, 13, 14, 15, 16:
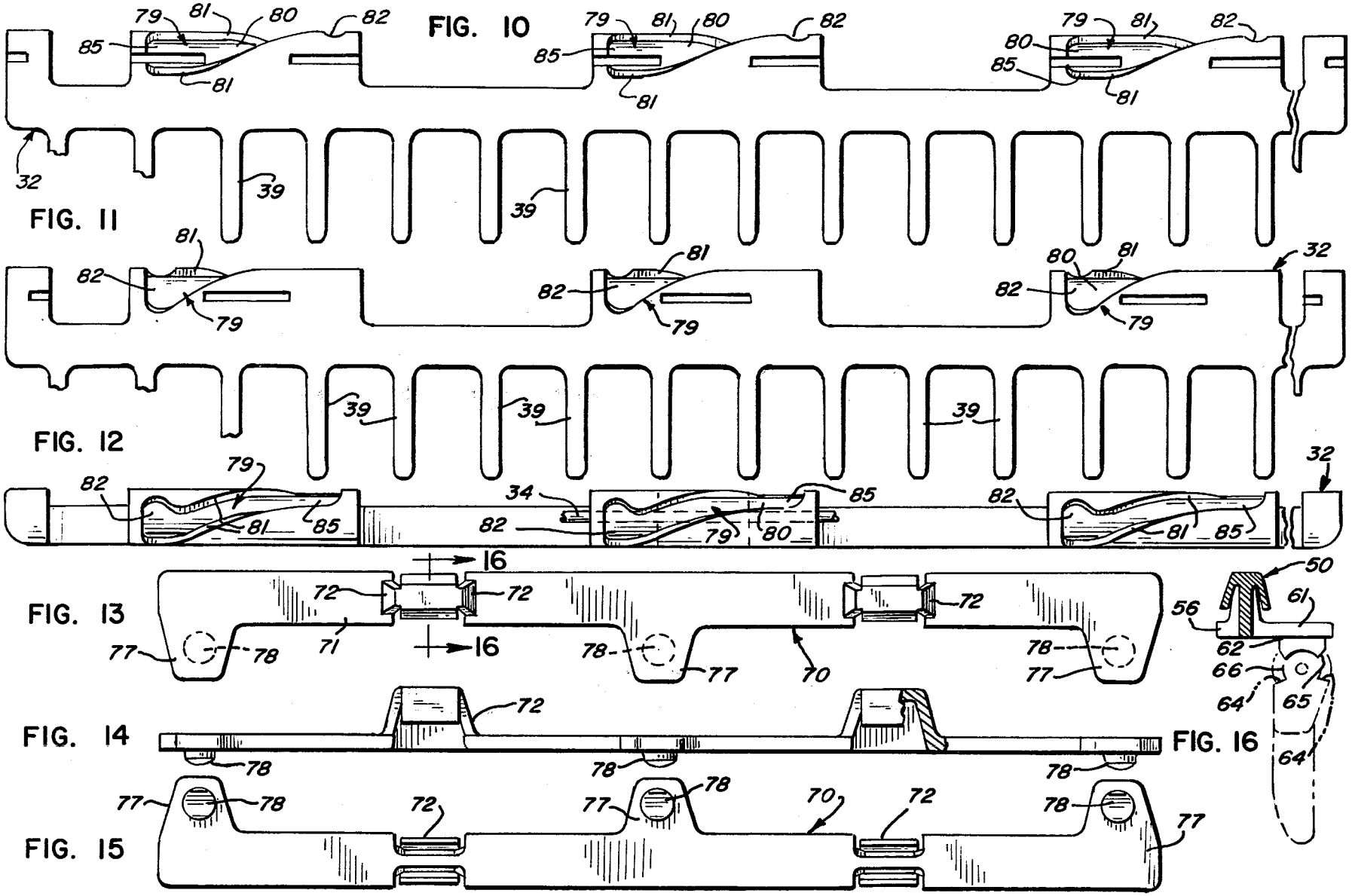
Figures 19, 20, 21, 22, 22A, 23, 24, 24A:
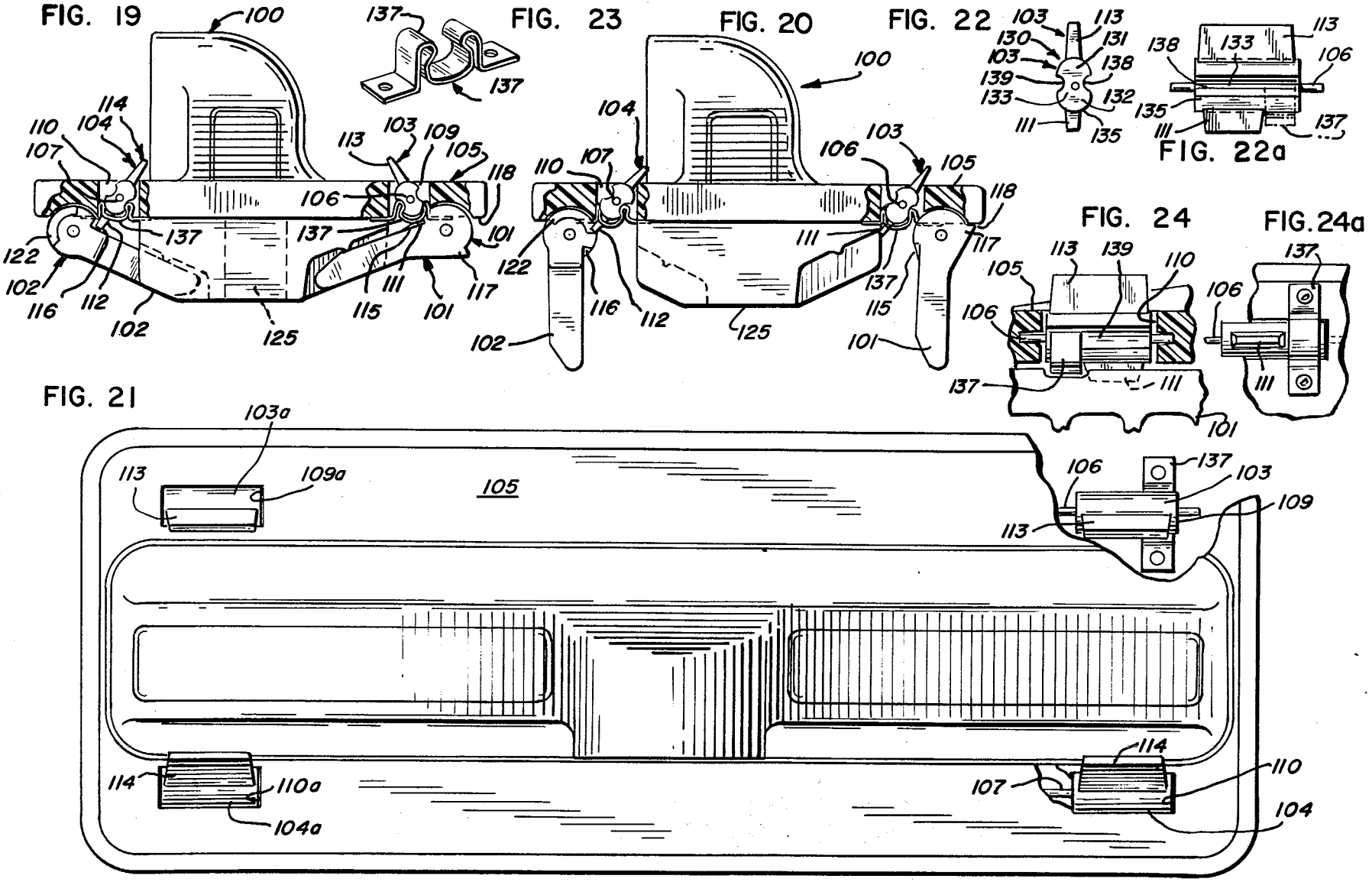
Figure 26B:
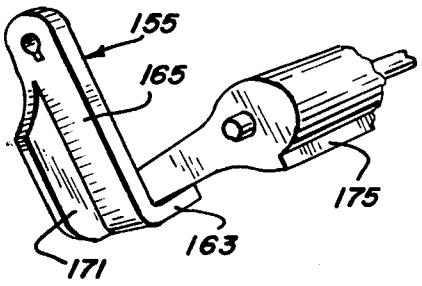
Figure 26A:
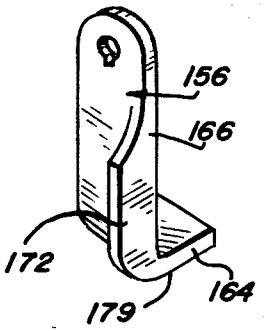
Figure 25:
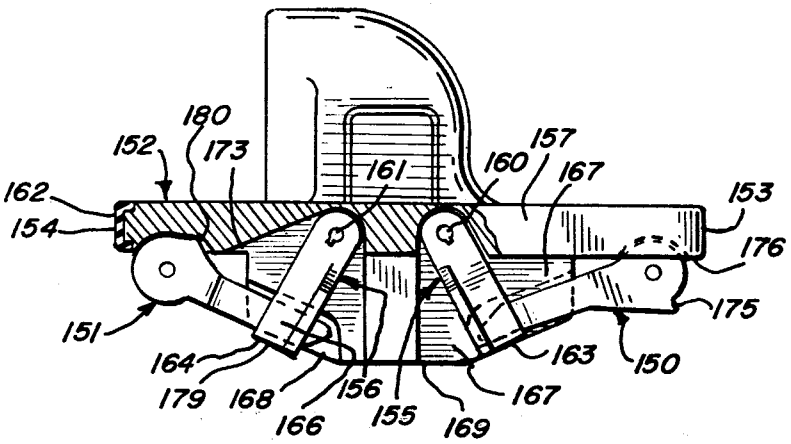
Figure 28:
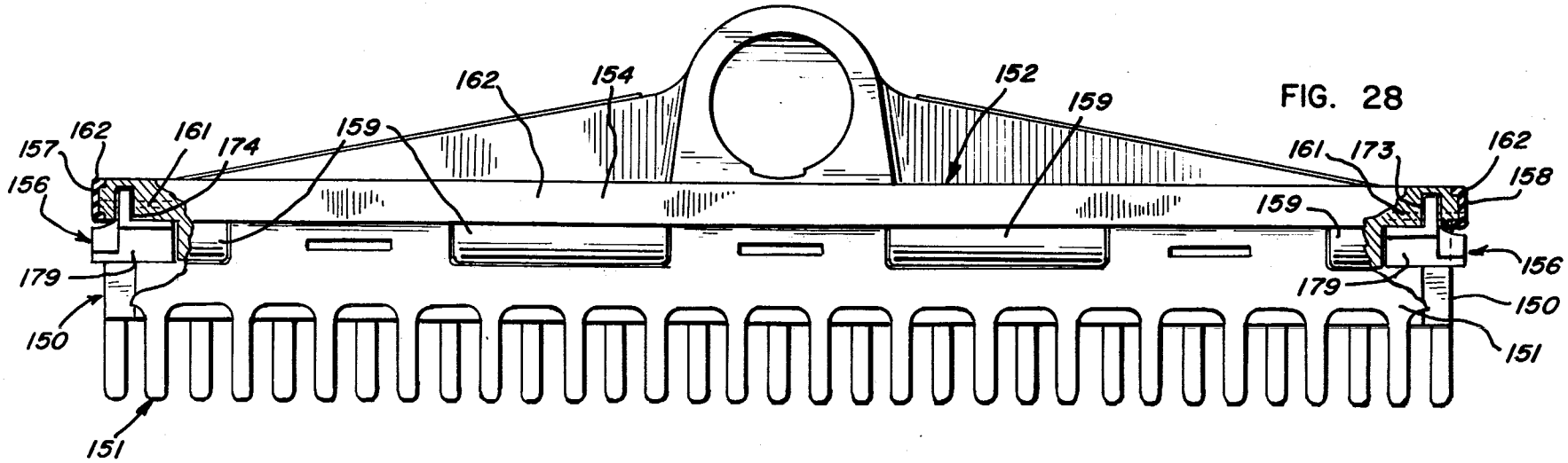
Figure 30A:
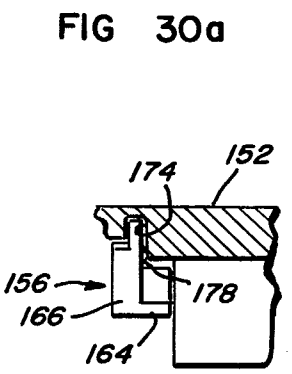
Figure 30:
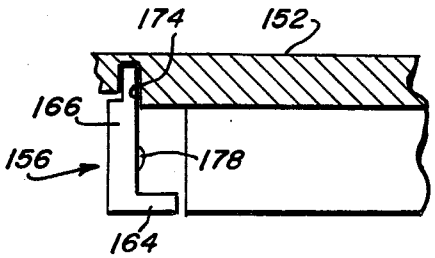
Figure 27:
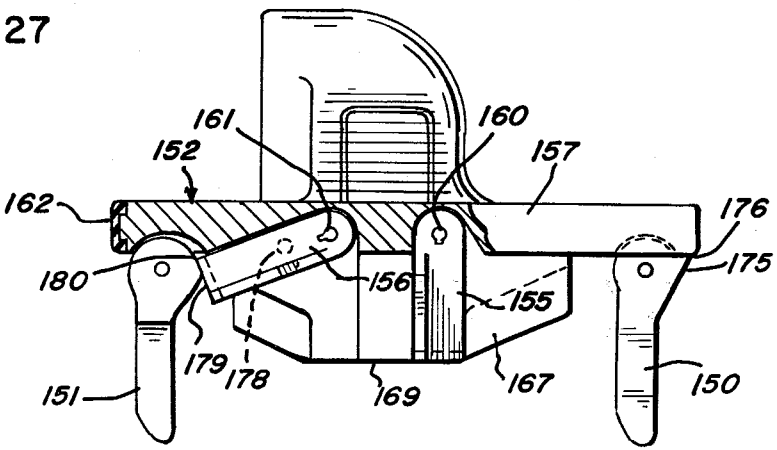
Figure 29:
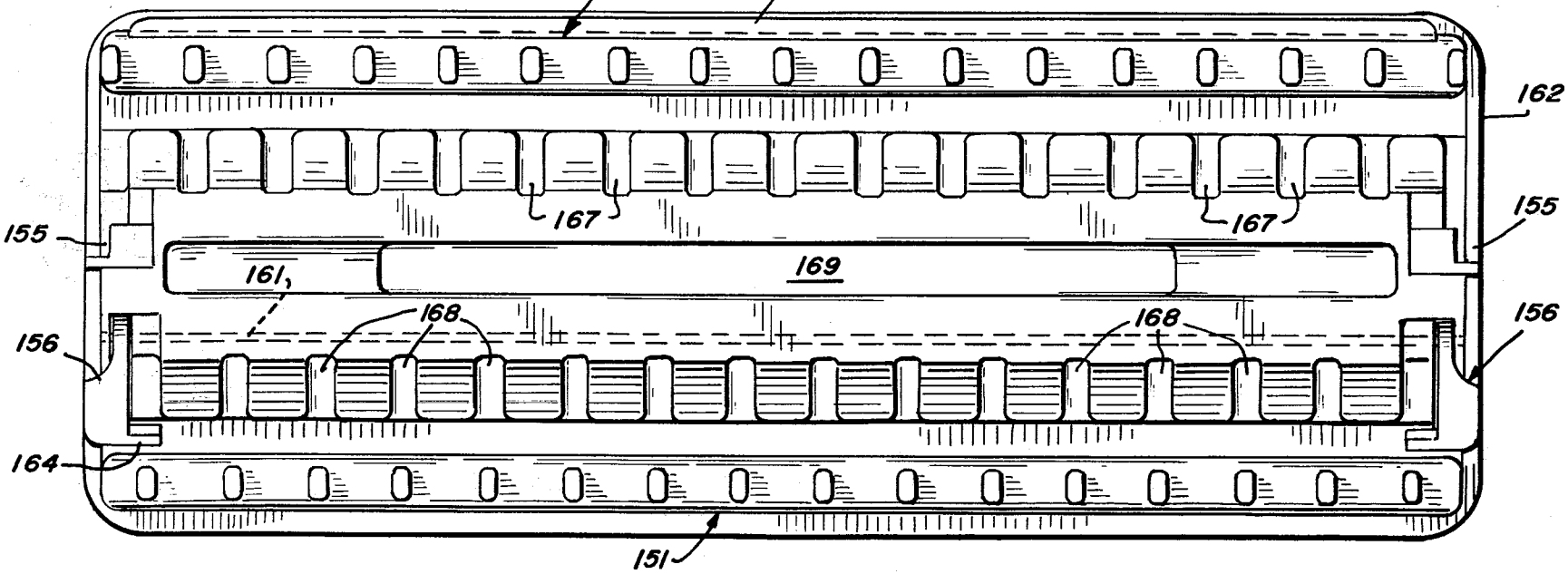
Figure 31:
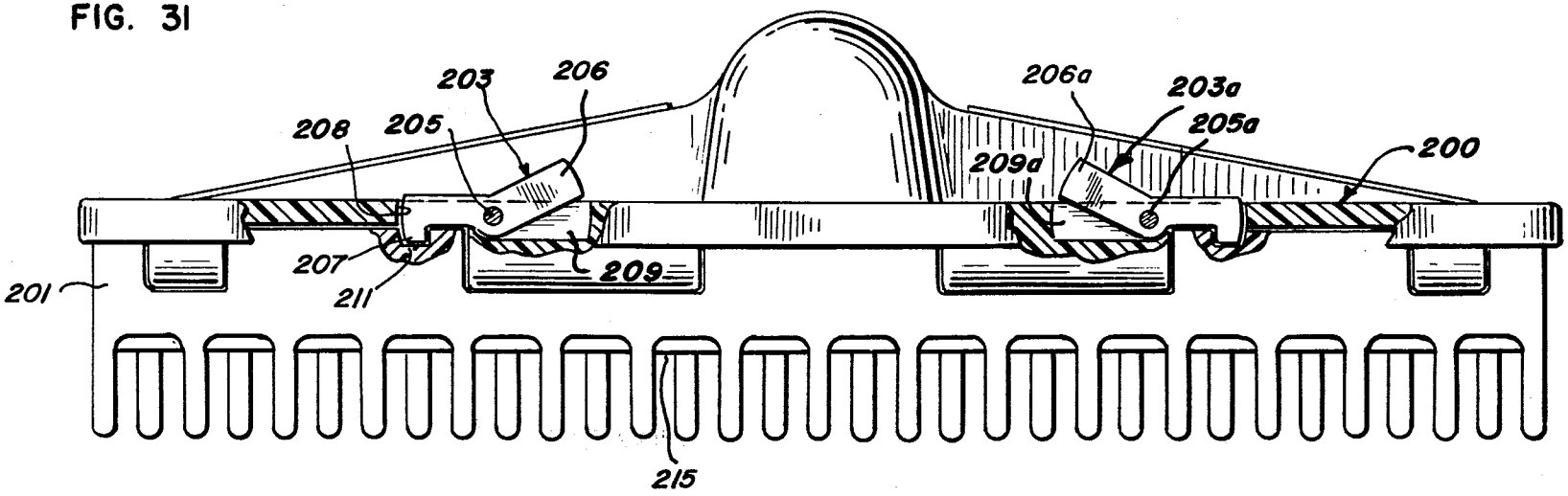
Figure 33:
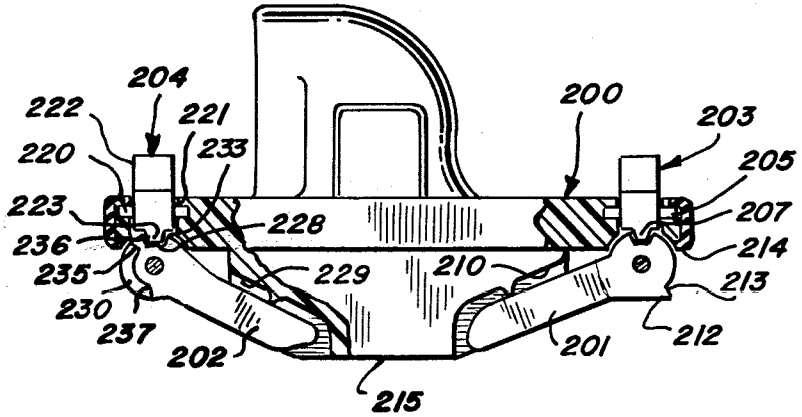
Figure 32:
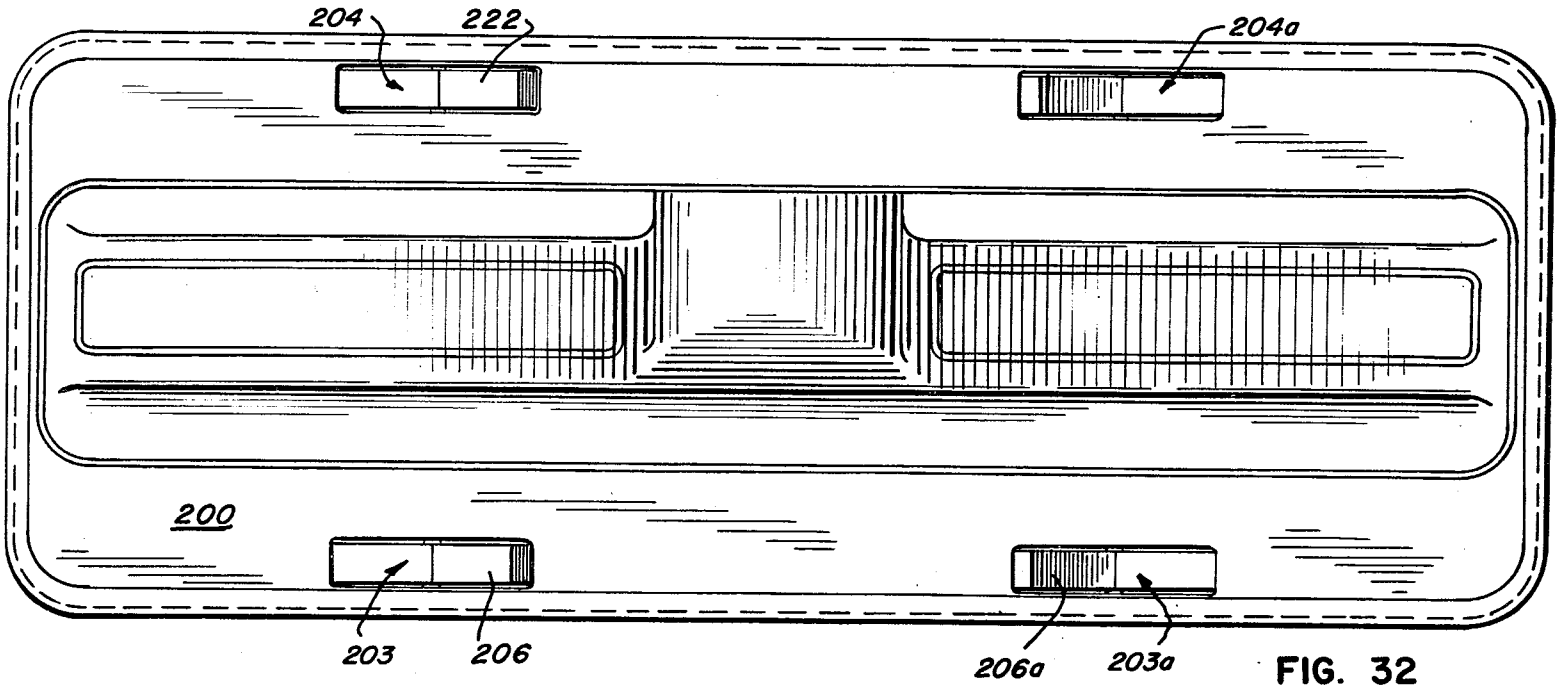
Figure 34:
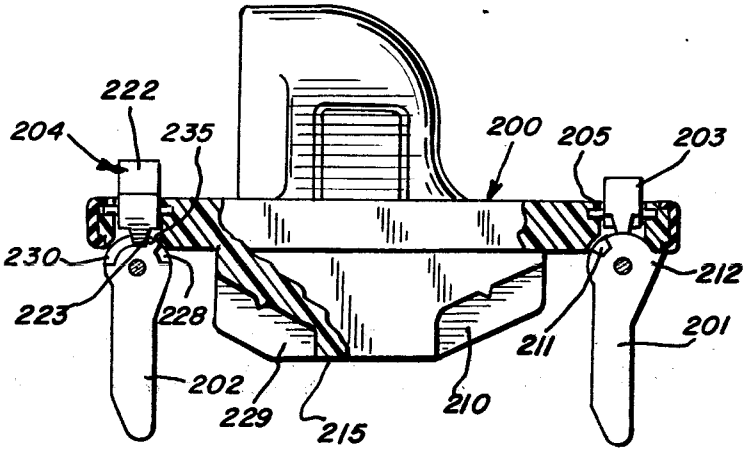

FIG. 8*a* is a fragmentary front elevational view of the front rake member of FIG. 7;

FIG. 9 is a top plan view of the rake member of FIG. 8;

FIG. 10 is a fragmentary elevational view taken along the line 10—10 of FIG. 7;

FIG. 11 is a fragmentary elevational view taken along the line 11—11 of FIG. 7;

FIG. 12 is a top plan view of the rake member of FIG. 11;

FIG. 13 is a fragmentary top plan view taken along the line 13—13 of FIG. 7;

FIG. 14 is a side elevational view of the cam slide member of FIG. 13;

FIG. 15 is a bottom view of the cam slide member of FIG. 13;

FIG. 16 is a vertical sectional view taken along the line 16—16 of FIG. 13;

FIG. 17 is an end elevational view of the nozzle with sole plate and rake latch assembly of FIG. 5;

FIG. 18 is a fragmentary sectional view taken along the line 18—18 of FIG. 5;

FIG. 19 is an end elevational view partially in vertical section illustrating a modified form of nozzle with sole plate and rake latch assembly embodying the present invention;

FIG. 20 is an end elevational view partially in vertical section of the nozzle with sole plate and rake latch assembly of FIG. 19 in an alternate position of adjustment;

FIG. 21 is a top plan view of the nozzle with sole plate and rake latch assembly of FIGS. 19;

FIG. 22 is a side elevational view of a component element of the rake latch assembly of FIG. 19;

FIG. 22*a* is a front elevational view of the element of FIG. 22;

FIG. 23 is a perspective view of another component of the rake latch assembly of FIG. 19;

FIG. 24 is an enlarged fragmentary side elevational view partially in vertical section of the rake latch assembly of FIG. 19;

FIG. 24*a* is an enclosed fragmentary bottom elevational view of the rake latch assembly of FIG. 24;

FIG. 25 is an end elevational view partially in vertical section of a vacuum cleaner nozzle with sole plate and rake latch assembly illustrating a further modified form of the present invention;

FIG. 26*a* is an enlarged diagrammatic view of a detail of one of the elements of the rake latch assembly of FIG. 25;

FIG. 26*b* is a diagrammatic fragmentary perspective view of one of the elements of the rake latch assembly of FIG. 25 in engagement with a rake member of FIG. 25;

FIG. 27 is an end elevational view of the nozzle sole plate and rake latch assembly of FIG. 25 in a different position of adjustment;

FIG. 28 is a rear elevational view of the nozzle with sole plate and rake latch assembly of FIG. 25;

FIG. 29 is a bottom elevational view of the nozzle with sole plate and rake latch assembly of FIG. 27;

FIG. 30 is a fragmentary front elevational view partially in vertical section of the nozzle with sole plate and rake latch assembly of FIG. 25 in a different position of adjustment;

FIG. 30*a* is a fragmentary front elevational view partially in vertical section of the nozzle with sole plate and rake latch assembly of FIG. 27;

FIG. 31 is a front elevational view partially in vertical section of a still further modified form of a vacuum cleaner nozzle with sole plate and rake latch assembly embodying the present invention;

FIG. 32 is a top plan view of the nozzle sole plate and rake latch assembly of FIG. 31;

FIG. 33 is a side elevational view partially in vertical section of the nozzle, sole plate and rake latch assembly of FIG. 31; and FIG. 34 is a side elevational view partially in vertical section of the nozzle with sole plate and rake latch assembly of FIG. 31 in a different position of adjustment.

The several objects of the present invention are achieved by providing a vacuum cleaner nozzle having a generally rectangular planar lower end section and an air passage extending therethrough which is adapted to be connected to a suction means of a vacuum cleaner with a sole plate member having a generally rectangular main body section adapted to be connected to and enclose the generally rectangular lower end section of the vacuum cleaner nozzle. The sole plate member extends below the lower end section of the vacuum cleaner nozzle, forming the rug engaging portion, and has an air intake means which connects with the air passage of the vacuum cleaner nozzle. A rake member is pivotally mounted on the sole plate member preferably adjacent both the forward and trailing edges thereof, and each rake member has associated therewith means for controlling the position of the rake and pivotal movement thereof so that in one position of adjustment the teeth of at least one rake member are adapted to preferably extend perpendicularly downwardly below the transverse (i.e., horizontal) plane of the lower end of the air intake opening when the nozzle is moved in one direction and are adapted to be pivotally movable from a perpendicular downwardly extending position to a position in which the teeth extend in a generally rearwardly direction when the nozzle is moved in a diametrically opposite direction with the lower ends of the rake lying in a transverse plane which is no lower than the transverse plane of the lower surface of the air intake opening of the nozzle. The rake members are also preferably provided with means for latching the rake member in a retracted or nested position against the lower surfaces of the sole plate member when raking is not required, as when it is desired to have the air intake opening remain in direct contact with the surface to be cleaned.

With particular reference to FIGS. 1–18 of the accompanying drawing, a vacuum cleaner nozzle 20 is shown with a suction housing section 21 which can be of any conventional form but preferably has a generally elongated rectangular lower end configuration with an air passage 22 extending medially therethrough. The upper end 23 of the air passage 22 extends rearwardly and is adapted to be connected to a suction wand (not shown) and flexible hose leading to a conventional tank-type vacuum cleaner (not shown). A sole plate 24 with a generally elongated rectangular planar main body portion 25 is secured to the lower surface of the housing section 21 by any suitable means, such as the threaded fasteners 26, so as to engage and enclose the generally rectangular lower end 21 of the housing section 20. The downwardly and inwardly inclined forward wall 27 and rear wall 28 of the sole plate 24 together with a transverse planar surface 29 define an elongated generally rectangular air inlet slot or opening 30 extending substantially the length of the sole plate 24 and communicating directly with the lower end of the air passage 22 of the housing section 20.

The sole plate 24 has mounted thereon adjacent the upper ends of the longitudinally extending front and rear edges thereof forward and rear rake members 31, 32, respectively, which are adapted to be moved pivotally within predetermined limits about axles or supporting pins 33, 34, respectively. The axles or pins 33, 34 are supported at spaced points along the longitudinal edges of the sole plate 24 by means of spaced depending lugs 35, 36, respectively. Each of the rake members 31, 32 has a plurality of spaced teeth 38, 39, respectively, the lower ends of which preferably extend below the transverse plane of the lower end of the air inlet slot 30 when the said teeth extend perpendicularly downwardly. A resilient strip or bumper 40 is mounted on the outermost edges of the flange 37 along the entire periphery of the sole plate 24.

The downwardly and inwardly inclined walls 27, 28 which extends the length of the sole plate 24 are not symmetrically formed relative to the lower surface 29 and the air intake opening 30. Thus, in the preferred form shown in FIGS. 1, 6 and 7 the rear wall 28 is preferably spaced rearwardly a short distance from the air intake opening 30 with a short transverse wall 41 extending between the lower ends of the inlet opening 30 and wall 28. A vertical wall portion 42 extends upwardly from the uppermost end of the inclined wall 28 with a transversely flange portion 43 extending from the upper end thereof. The forward wall 27 has a short vertically extending wall portion 44 at the upper edge of the wall 27. A transverse flange portion 45 extends outwardly from the wall 44.

Each of the surfaces 27, 28 of the sole plate 24 is preferably provided with a plurality of spaced grooves or recessed areas 46, 47, respectively, which are adapted to receive in retracted nesting position therein the teeth 38, 39, respectively of the rake members 31, 32, so they can be disposed in retracted or nested position with the outermost surface of the inclined surfaces 28, 29, respectively, substantially in the plane of the outer surface of the inclined walls 27, 28, respectively, and thereby presenting a generally smooth outer forwardly and rearwardly inclined surfaces for contacting a rug surface (see FIG. 17).

The rake members 31, 32 (in one operative position of adjustment of their rake control means 50 and 70 to be described in detail hereinafter) are adapted to be moved pivotally between a position in which the teeth of both rake members 31, 32 extend perpendicularly downwardly (see FIG. 6) and a position in which both rake members 31, 32 extend toward the trailing edge of the sole plate 24 (see dotted line position in FIG. 7). In the latter position the lower ends of the teeth 38, 39 are disposed in or above the transverse plane of the lower end of the air intake slot 30 when the nozzle is moved forwardly with the planar surface 29 and the air intake opening in direct contact with the supporting rug or floor surface. When the nozzle is moved in a rearwardly direction while in contact with a rug or like supporting surface, the rake members 31, 32 are moved pivotally downwardly and forwardly by frictional engagement with a rug surface but are allowed to move only to the perpendicular downwardly extending position by their control means. In the above described position of adjustment, the nozzle is adapted for both raking and cleaning a shag-type rug.

In an alternate position of adjustment of the rake control means, both the rake members 31, 32 are moved pivotally upwardly and inwardly into a nesting position adjacent the inclined surfaces portions 27, 28, respectively, and are locked or held in retracted position with the teeth 38, 39 preferably nested in grooves 46, 47 formed in the inclined surfaces portions 27, 28, respectively. The inner surfaces of the retracted rake members 31, 32 are spaced slightly from the inner walls of the grooves 46, 47 by spacer studs 90, as best shown in FIGS. 6, 7. In this alternate position of adjustment the lowermost ends of the rake members 31, 32 are disposed above the lower end of the air intake slot 30 so that the lower end of the air intake slot 30 is maintained in direct contact with the rug or other surface when the nozzle is moved forwardly and rearwardly over the surface of a rug. In the latter position of adjustment, the nozzle is best adapted for cleaning a short nap rug or bare floor surfaces.

The rake control or latch means 50 which is operatively associated with the forward rake member 38 (as best shown in FIGS. 2 and 7–9) is adapted to limit the movement of the rake member 31 and controls the positioning of the rake member 31 relative to the sole plate 24 in order to best adapt the nozzle either for raking and cleaning a shag-type rug or for cleaning a bare floor or a rug with short nap or no nap. In the preferred embodiment shown in FIGS. 1–18 of the drawing the control means 50 comprises a cam actuating slide bar 56 which operatively co-acts with cam tracks 63 formed in the upper end surface of the front rake member 31. The slide bar 56 is mounted for reciprocal longitudinal movement within a longitudinally extending passage 57 formed in the sole plate 24 midway between the opposite ends of the sole plate 24 and spaced above and rearwardly of the support lugs 35 for the axle pin 33. The cam slide bar 56 is provided with spaced actuating knobs 58 which are tapered so as to be snap-fitted from below into the passage 57 formed in the sole plate 24 with the lower longitudinal edges 59 of the knobs 58 adapted to resiliently and slidably engage a shoulder 60 formed along the upper longitudinal edges of the passage 57, thereby retaining the slide bar 56 within the passage 57.

The cam slide bar 56 also has three cam support sections 61 which extend forwardly from points spaced inwardly of the opposite ends and the midpoint thereof and which have provided on the lower surface thereof three cam members 62. The cam members 62 are adapted to operatively engage in the spaced cam tracks or grooves 63 formed in the upper end portions of the rake member 31, as best shown in FIGS. 8, 9 and 16 of the drawing. The three cam tracks 63 have lateral walls 64 which are preferably perpendicular to the inner surface of the track 63 and are adapted to engage with the outer lateral walls 65 of the cam members 62. The cam tracks 63 has a curved outer surface 66 which conforms with the curvature of the lower surface of the cam members 62.

The cam tracks 63 are each formed with an enlarged portion 67 at one end to allow the rake member 31 to be moved pivotally (when the cam member 62 remains in the enlarged end portion 67) between the vertical position and the rearwardly extending dotted line position shown in FIG. 7. The cam tracks 63 extend from the enlarged end portion 67 longitudinally along the upper surface of the rake member 31 toward the narrow end portion 68 thereof with the width of the interconnecting portion of the cam tracks 63 being gradually reduced to substantially the width of the cam member 62. Thus, when the cam slide bar 56 with the cam members 62 is moved longitudinally along the cam tracks 63 formed in the rake member 31 from the enlarged portion 67 of the cam track into the narrow end portion 68, the rake member 31 is pivotally moved toward the inclined wall 27 of the sole plate section 24, and the rake teeth 38 are then disposed in retracted or nesting position in the grooves 46 formed in the sole plate 24.

The rake control means 70 for the rear rake member (as shown best in FIGS. 2 and 10–15) comprises a cam slide bar 71 having a form and construction identical to cam slide bar 56, is mounted in the same manner as the cam slide bar 56 and is operatively associated with the rear rake member 32. Thus, the slide bar 71 having spaced tapered control knobs 72 is snap-fitted into a longitudinally extending rectangular passage 75 formed adjacent the trailing edge of the sole plate 24. The lower edges of the tapered knobs 72 resiliently slidably engage the shoulder 76 formed along the longitudinal edges of the passage 75. The three cam members 78 which extend from each of the spaced cam support sections 77 of the cam slide bar 71 have the same general configuration as the cam members 62 and operatively engage in the cam tracks 79 formed in the upper end portion of the rake member 32.

The cam tracks 79, as best shown in FIGS. 10, 11 and 12, differ in the form from the cam tracks 63 of the rake member 31, because of the necessity of positively moving the rear rake member 32 forwardly into nesting position, in addition to limiting the pivotal movement thereof between a vertical position and a rearwardly extending position during raking when the rake is not locked in nesting position. Thus, the cam tracks 79 are comprised of elongated grooves having a generally spiral curvature formed in the upper end portion of the rake member 32 with the cylindrical outer surface 80 thereof conforming with the curvature of the lower surface of the cam member 78 and having lateral walls 81 which are generally perpendicular to the surface 80. The cam tracks 79 have one end 82 substantially wider than the cam member 78 which permits unrestricted pivotal movement of the rake member 32 from the vertical position rearwardly until the lower ends of the teeth 39 of the rake member 32 are at least in the transverse plane or above the transverse plane of the lower end of the air intake slot 30. The lateral wall portion 81 of the enlarged end portion 82 of the cam tracks 79 is angularly positioned on the cylindrical upper end surface of the rake member 32 so that the rake member 32 is free to move pivotally rearwardly to the dotted line position shown in FIG. 7 but is restrained from moving forwardly beyond the perpendicular while the cam members 78 remain in the enlarged end portions 82 of the cam tracks 79.

The cam tracks 79 extend longitudinally generally spirally from the enlarged ends 82 toward the narrow ends 85. A reduction in width of the cam track 79 is provided adjacent the narrow ends 85 to assist in maintaining the cam member 78 in the narrow end portions 85 of the cam tracks 79. And, as best shown in FIG. 12, the narrow end portions 85 are angularly so disposed on the cylindrical surface of the rake member 32 so that the rake member 32 will be pivotally moved forwardly beyond the perpendicular until the teeth 39 are in nesting position within the recesses 47 formed in the rearwardly inclined wall surface 28 of the sole plate 24 when the cam members 78 are moved longitudinally along the cam tracks 79 into the narrow end portions 85.

In the preferred embodiment resilient means, such as torsion springs 91 are provided for moving the rake member 31 pivotally forwardly and outwardly away from the retracted or nesting position in the grooves 46 formed in the inclined surface 27 when the cam slide bar 56 is moved longitudinally to release the rake member 31 from locked position. As best shown in FIG. 18, the torsion spring 91 is mounted on the axle 33 which pivotally supports the rake member 31 with one end of the torsion spring 91 seated in a recess 92 formed in the axle supporting lugs 35 of the sole plate 24 and the other end of each said torsion spring 91 being seated in recess 93 formed in the inner surface of the rake member 31. When the rake member 31 is moved into retracted position with the inner surface of rake member engaging a spacing stud 90 (see FIG. 18) the torsion spring 91 is compressed and air remains between the rake member 31 and the wall 27. When the retracting force of the rake control means 50 is released, the lower end of the rake member 31 is urged pivotally outwardly away from wall 27 by the torsion springs 91.

It will be understood that mechanical means other than the slide-cam means described above can be used to control the movement or positioning of the pivotally mounted rake members without departing from the scope of the present invention. Thus, in FIGS. 19–24*a* of the drawing alternate mechanical means are shown for positioning and limiting the pivotal movement of the front and rear rake members 101, 102 of the nozzle 100 relative to the sole plate 105 which is generally similar to the sole plate 24 shown in FIGS. 1–18. FIGS. 19–24*a* show a front rake latch assembly comprising spring-biased pivotal latch members 103, 103*a* mounted on a pin 106 pivotally supported by spaced lugs formed on the sole plate 105 above and adjacent the ends of each of the rake members 101. The front latch members 103, 103*a* are mounted in spaced passages 109, 109*a* formed in the sole plate 105, respectively, and can be interconnected by the pin 106 mounted in the sole plate 105 with the axis thereof parallel to the axis of the rake member 101. The rear latch members 104, 104*a* are also supported on a pivotally mounted pin 107 in passages 110, 110*a* in the sole plate 105. The lower limbs 111, 112 of the latch members 103, 104, respectively, are adapted to engage the rake members 101, 102, respectively, with the upper limb or control arms 113, 114, respectively, extending above the upper surface of the sole plate 105.

As best shown in FIG. 20, a notch 115, 116 is formed in the inner lateral surface adjacent the upper ends of each of the rake members 101, 102, respectively. When the lower limbs 111, 112 of the spring-loaded front and rear latch members 103, 104, respectively, engage in the notches 115, 116, the rake members 101, 102, respectively, are latched in retracted or nested position adjacent the inclined lower surface of the sole plate section 105 so that the lower ends of the rake members 101, 102 do not extend below the plane of the lower end of the air intake opening 125. When the front rake member 101 is released from its retracted position, as by moving the control arm 113 of the front latch 103 forwardly (see FIG. 20), the rake member 101 is free to move pivotally downwardly until it extends perpendicular to the transverse plane of the sole plate section 105. Pivotal movement of rake member 101 forwardly beyond the perpendicular is prevented by providing one or more stop lugs 117 formed adjacent the upper end of the front rake member 101 on the forwardmost edge thereof for engagement with an abutment surface 118 on the lower front edge of the sole plate 105 when the rake member 101 is in a perpendicular raking position and the vacuum cleaner nozzle is being moved rearwardly over a supporting surface.

The rear latch member 104 releases the rake member 102 from its retracted or nested position when the control arm 114 is moved rearwardly and the lower limb 112 is moved out of engagement with notch 116. The rake member 102 is then free to pivotally move into a vertical depending position.

The rear rake member 102 when not held in retracted position is prevented from being moved pivotally forwardly beyond the perpendicular position when the vacuum cleaner nozzle is moved rearwardly over a supporting surface by providing a cam groove or slot 122 in the upper rounded end surface of the rake member 102 in which the lower limb 112 of the latch member 104 is adapted to engage. The length of the slot 122 and the positioning thereof on the upper end of the rake member 102 is such that while the lower limb 112 of the latch member 104 is engaged in the slot 122, the rake member cam moves freely rearwardly so that the lower end of the rake 102 will not extend below the plane of the lower end of the air intake opening when the vacuum cleaner nozzle is moved forwardly over a supporting rug surface but will not move beyond the perpendicular downwardly extending raking position when the nozzle is moved rearwardly over a supporting rug surface.

The latch members 103, 104 are spring biased so as to maintain the rake members latched in either the retracted position or in the raking position by providing each of the latch members 103, 103*a* and 104, 104*a* with a generally rounded or eliptical main body portion 130 which in cross-section preferably has a violin-like configuration with generally semi-circular end sections 131, 132 and an interconnecting reduced intermediate or midsection 133 forming therein oppositely disposed grooves 138, 139. The curved outer lower lateral surface of the semi-circular lower end section 132 are smooth so as to provide a suitable rounded surface 135 for engagement by a U-shaped spring clip member 137 which is adapted to have the upper end portion of one of the resilient arms of the spring clip member 137 resiliently engage in one of the oppositely disposed lateral grooves 138, 139 formed between the end sections 131, 132, as best shown in FIGS. 19, 20. The upper end portion of one of the arms of the U-shaped spring clip member 137 is adapted to snap into one or the other of the lateral grooves 138, 139 while the other arm of the U-shaped spring clip resiliently engages the surface 135, depending on whether the control arm 113, 114 is in a forwardly or rearwardly extending position. FIG. 23 illustrates one form of the spring clip member 137 suitable for use in the latch assemblies 103, 104.

In FIGS. 25–30*a* an alternate latch means is shown for positioning the rake members 150, 151 relative to a sole plate 152 of a vacuum cleaner nozzle. In the latter embodiment the front and rear rake members 150, 151 are pivotally mounted in spaced lugs 159 formed adjacent the forward and trailing edges 153, 154 of the sole plate 152 with the sole plate 152 having the same generally rectangular shape and lower surface conformation as in the embodiment shown in FIGS. 1–18. The means for controlling the position of the front and rear rake members 150, 151 comprise front and rear latches 155, 156, respectively, pivotally mounted adjacent the transverse or short end walls 157, 158, respectively, of the sole plate 152. A front latch 155 is preferably disposed opposite each end of the front rake 150 within the area enclosed by the protective bumper 162. Each front latch 155 is preferably interconnected by a common axle 160 so that when either one of the front latches 155 is moved the other front latch 155 will also be moved simultaneously into a like position of adjustment. The rear latch 156 is similarly mounted relative to the ends of the rear rake 151 and the sole plate 152 on a common axle 161.

Each of the front and rear latches 155, 156 has a generally L-shaped cross sectional configuration (see FIGS. 26*a* and 26*b*) with the lower end flanges 163, 164, respectively, inwardly extending toward the oppositely disposed end of the front and rear rake members 150, 151, respectively. The length of the depending latch arms 165, 166 of the latches 155, 156, respectively, is such that, when extending vertically downwardly the lower end thereof does not extend below the lower end of the air intake passage 169 (see FIG. 27). When these latch arms are moved pivotally outwardly toward the rake member 150, 151, respectively, the inner surface of the lower end flanges 163, 164 are adapted to engage the lower end surface of the front and rear rake member 150, 151, respectively, and frictionally hold these rake members in retracted or nested position adjacent the forwardly and rearwardly inclined wall surfaces 167, 168, respectively, of the sole plate 152 (see FIG. 25). Each of the latch arms 165, 166 is provided with an outwardly extending actuating flange 171, 172, respectively, to facilitate pivotally moving the latch arm into and out of frictional engagement with one of the rake members. The inner surface of the rear latch arm 166 is also provided with an outwardly extending tab 178 which is adapted to frictionally engage a wall surface 174 of the sole plate when the latch is moved upwardly, as best shown in FIG. 30*a*.

When it is desired to effect raking of a rug surface in addition to cleaning, the latches 155, 156 are moved from their above described position of frictional engagement with the lower ends of the rake members, so that the rake members 150, 151 drop perpendicularly downwardly into raking position. The front rake member 150 is restrained from pivotally moving forwardly beyond the perpendicular raking position by providing on the upper forward edge thereof one or more stop lugs 175 adapted to engage an abutment surface 176 on the lower forward edge of the sole plate 152 whenever the nozzle is moved rearwardly over a rug surface. When the nozzle is moved forwardly over the supporting surface, the rake member 150 will be free to move pivotally rearwardly until the lower end thereof is substantially in the plane of the lower end of the air intake opening 169.

If it is desired to have the rear rake member 151 rake a rug surface simultaneously with the front rake member 150, the rear latch arms 166 are pivotally moved forwardly out of frictional engagement with the lower end of the rake member 151, releasing the rear rake member 151 from its retracted position adjacent surface 168. Each rear latch arm 166 has on its inner lateral surface a tab 178 which is adapted to form a secure frictional engagement with a vertical wall section 173, 174 of the sole plate 152 when moved rearwardly and upwardly until the latch arms 166 are held in a generally upwardly and rearwardly extending position. The outer surface of the lower end of the flange 164 provides an abutment surface 179 for engagement by an abutment surface 180 formed on the forward upper end of the rake member 151. The rake 151 is thus restrained from being pivotally moving forwardly beyond the perpendicularly downwardly extending raking position, when the rake 151 is moved rearwardly. The curvature of the upper end of the rake member 151 is such that the rake member 151 is freely pivotally movable rearwardly until the lower end thereof is substantially in the plane of the lower end of the air intake opening 169, when the nozzle is moved forwardly over a supporting rug surface.

In a further modified form of a rake latch assembly for a sole plate 200 shown in FIGS. 31 through 34 of the drawing, the front and rear rake members 201, 202 are controlled by spring loaded rocker latches 203-203*a* and 204-204*a*, respectively. Each of the rocker latches 203, 203*a* is comprised of a non-linear rocker arm 206, 206*a*, respectively, which is pivotally supported on a transversely extending axle 205, 205*a* mounted preferably in a recess 209, 209*a* formed in the upper surface of the sole plate 200 spaced inwardly from each end of the sole plate 200 and disposed directly above the longitudinal axle of the front rake 201. The outer end of the rocker arm 206 of the front rocker latch 203 has a depending pawl 207 which is adapted to extend downwardly through a passage 208 formed in the sole plate 200 and which engages in a recess 211 formed in the upper end surface of the rake 201. The dimensions of the recess 211 and the position thereof on the upper end of the front rake 201 are such that the pawl 207 fits securely in the recess 211 when the front rake 201 is in the retracted or nested position in relatively close proximity to the forwardly inclined surface 210 of the sole plate 200. When the rocker 206 is moved so that the pawl 207 is pivotally moved upwardly, the pawl 207 disengages from the recess 211 and the lower end of the front rake 201 is free to move into a downwardly extending vertical raking position. As best shown in FIGS. 33 and 34, the front rake 201 is provided with a stop lug 212 on the forward edge of the upper end portion thereof. The upper surface 213 of the lug 212 is adapted to engage an abutment surface 214 on the under surface of the sole plate 200 adjacent the forward edge of the main body section of the sole plate 200 when the rake 201 is in vertical raking position. Thus, when the front rocker latch 203 is in the non-locking position and the sole plate moved rearwardly over a supporting surface, the rake 201 is restrained from pivotally moving forwardly beyond the perpendicular raking position in the above described manner. The front rake 201 is free to pivot rearwardly until the lower ends of the rake 201 are substantially in the plane of the lower end of the air intake opening 215 when the sole plate 200 is moved forwardly over a supporting surface.

The rear rake 202 is controlled by a similar spring loaded rear rocker latch 204 having a non-linear rocker arm 222 mounted on a transverse axle 220 mounted in an opening 221 in the upper surface of the sole plate 200. Preferably one such rocker latch 204 is spaced inwardly from each lateral edge of the sole plate 200 and disposed directly above the longitudinal axis of the rake 202. The rocker arm 222 of the rear rocker latch 204 also has on one end thereof a depending pawl 223 adapted to extend downwardly through opening 221 formed in the sole plate for engagement in a recess 228 formed in the upper end surface of the rear rake 202. The dimensions of the recess 228 and the position thereof on the upper end of the rear rake 202 are such that the pawl 223 fits securely in the recess 228 when the rear rake 202 is locked in retracted or nested position with the lower end of the rake 202 in relatively close proximity to the rearwardly inclined surface 229 of the sole plate 200.

The upper end of the rear rake 202 is further provided with a track or groove 230 which is circumferentially spaced from the recess 228 and into which the pawl 223 formed on the end of the rocker arm 222 is adapted to extend when the rocker arm 222 is moved pivotally downwardly while the rake member 202 is in the vertical raking position. The dimensions of the groove 230 and the relative position thereof on the upper end of the rear rake 202 are such that the leading lateral edge 233 of the pawl 223 engages the leading edge 235 of the groove 230 when the rear rake 202 is in a vertical raking position. The groove 230 has a length such that the rear rake 202 can be pivotally moved rearwardly until the lower ends of the rake teeth are substantially in the plane of the lower end of the air intake opening 215 when the trailing edge 236 of the pawl 223 engages the end wall 237 of the slot 230. Thus, with the pawl 223 of the rear rocker latch 204 disposed in the groove 230, the rear rake 202 is restrained from being pivotally moved forwardly beyond the perpendicular raking position when the sole plate 200 is moved rearwardly over a supporting surface, such as a rug surface, but is free to pivotally move rearwardly until the lower end of the rear rake 202 is substantially in the plane of the lower end of the air intake opening 235 when the sole plate is moved forwardly over a supporting surface. It will be understood that any conventional suitable spring means can be used to maintain the rocker latches 203, 204 in either the "lock" or the "unlock" position until actuated by depressing the elevated side of the respective rocker arms.

We claim:

1. In a vacuum cleaner nozzle which has a suction housing section with an air passage extending therethrough adapted to be connected with suction means of a vacuum cleaner, a sole plate member having a generally rectangular main body section which encloses the lower end of said housing section, said sole plate member having an elongated longitudinally extending air intake opening defined by an aperture in a lower wall section of said body section and communicating with said air passage of said vacuum cleaner nozzle suction housing, a rake member pivotally mounted on said main body section of the sole plate member adjacent a longitudinal edge of said sole plate member and said rake member having spaced depending teeth adapted for raking a shag-type rug, rake control means associated with said sole plate and said rake member which in a first position of adjustment is adapted to allow said rake member to move into a downwardly extending raking position perpendicular to the plane of the lower end of said air intake opening when said nozzle is moved in one direction over a supporting rug surface and said rake control means in a second position of adjustment adapted to hold said rake member in a retracted position with the said teeth disposed adjacent said lower wall section of the sole plate and with the lower ends of said teeth lying in a horizontal plane which is no lower than the plane of the lower end of said air intake opening, and said rake control means having a reciprocable cam member mounted on said sole plate adapted to slidably engage in a cam track formed in the upper end of said rake member and effect pivotal movement of said rake member from said raking position into said retracted position and hold said rake in said retracted position when said cam member is moved from said first position of adjustment into said second position of adjustment thereof.

2. A vacuum cleaner nozzle and sole plate assembly as in claim 1, wherein said sole plate has front and rear lower wall sections having recesses formed in the outer surface thereof to receive therein at least the said lower ends of said teeth so that the outer surface of said teeth are disposed substantially in the plane of the outer surface of one of said lower wall sections when a said rake member is maintained in said retracted position; whereby said nozzle is movable over a supporting surface with minimal frictional resistance and said air intake opening is in close proximity with said supporting surface to effect maximum cleaning action.

3. A vacuum cleaner nozzle and sole plate assembly as in claim 1, wherein the said rake member when in a perpendicularly downwardly extending position has the lower ends of teeth formed therein extending substantially below the lower end of said air intake opening.

4. A vacuum cleaner nozzle and sole plate assembly as in claim 1, wherein said cam track has an enlarged section at one end of sufficiently greater size than the said cam member to permit said rake member being movable pivotally from said raking position into a position in which the lower ends of said teeth are substantially in the plane of the lower end of said air intake opening when said cam member is moved into said one end of said cam track, and said cam track at the opposite end thereof having a form and size relative to the form and size of said cam member such that the said rake member is held in said retracted position when said operating member is moved into said opposite end of said cam track.

5. A vacuum cleaner nozzle and sole plate assembly as in claim 1, wherein a resilient means is operatively associated with said sole plate and said rake member to urge the lower end of said rake member pivotally outwardly away from said lower wall section when said rake control means is in a position of adjustment which does not hold said rake member in said retracted position.

6. In a vacuum cleaner nozzle which has a suction housing section with an air passage extending therethrough adapted to be connected with the suction means of a vacuum cleaner, a sole plate member having a generally rectangular main body section which encloses the lower end of said housing section, said sole plate member having an elongated longitudinally extending air intake opening defined by an aperture in a lower wall section of said body section and communicating with said air passage of said vacuum cleaner nozzle suction housing, a rake member pivotally mounted on said main body section of the sole plate member adjacent each longitudinal edge of said sole plate member, each said rake member having spaced depending teeth adapted for raking a shag-type rug, rake control means associated with said sole plate and each said rake member, said rake control means having movable means mounted on said sole plate adapted to engage in a cam recess formed in the upper end of each said rake member and which in a first position of adjustment allow each said rake member to move into a downwardly extending raking position perpendicular to the plane of the lower end of said air intake opening when said nozzle is moved in one direction over a supporting rug surface, and when said movable means is moved in each said cam recess into a second position of adjustment said rake control means adapted to move each said rake member into a retracted position and hold each said rake member in said retracted position with the said teeth disposed adjacent said lower wall section of the sole plate and with the lower ends of said teeth lying in a horizontal plane which is no lower than the plane of the lower end of said air intake opening.

7. In a vacuum cleaner nozzle which has a suction housing section with an air passage extending therethrough adapted to be connected with the suction means of a vacuum cleaner, a sole plate member having a generally rectangular main body section which encloses the lower end of said housing section, said sole plate member having an elongated longitudinally extending air intake opening defined by an aperture in a lower wall section of said body section and communicating with said air passage of said vacuum cleaner nozzle suction housing, a rake member pivotally mounted on said main body section of the sole plate member adjacent each upper longitudinal edge of said main body section, each said rake member having spaced depending teeth adapted for raking a shag-type rug, said lower wall section formed of inclined front and rear lower wall surfaces having recesses formed in said lower wall surfaces adapted to receive the said teeth in nesting position therein when each said rake member is moved into a retracted non-raking position, rake control means associated with said sole plate and each rake member which in a first position of adjustment allow each said rake member to move into a downwardly extending raking position perpendicular to the plane of the lower end of said air intake opening when said nozzle is moved in one direction over a supporting rug surface, and said rake control means when moved to a second position of adjustment adapted to move each said rake member into a retracted position and hold each said rake member in said retracted position with the said teeth in nesting position in said recesses in said lower wall surfaces of the sole plate and with the lower ends of said teeth lying in a horizontal plane no lower than the plane of the lower end of said air intake opening.

8. A vacuum cleaner nozzle and sole plate assembly as in claim 1, wherein said cam member is reciprocably disposed in said cam track to effect movement of said rake member into and out of said retracted position.

* * * * *